US006050859A

United States Patent [19]

Abe et al.

[11] Patent Number: 6,050,859

[45] Date of Patent: Apr. 18, 2000

[54] COMBINED-TYPE CONNECTOR

[75] Inventors: Kimihiro Abe; Kentaro Nagai, both of Shizuoka, Japan

[73] Assignee: Yazaki Corporation, Tokyo, Japan

[21] Appl. No.: 09/176,936

[22] Filed: Oct. 22, 1998

[30] Foreign Application Priority Data

Oct. 22, 1997 [JP] Japan ..... 9-290092

[51] Int. Cl.[7] ..... H01R 13/502; H01R 13/514

[52] U.S. Cl. ..... 439/701

[58] Field of Search ..... 439/701, 752, 439/660, 599, 634, 684, 686, 695, 707, 712, 724, 731, 542, 533, 540.1

[56] References Cited

U.S. PATENT DOCUMENTS

| | | | |
|---|---|---|---|
| 5,122,077 | 6/1992 | Maejima et al. | 439/398 |
| 5,344,347 | 9/1994 | Inone et al. | 439/701 |
| 5,890,933 | 4/1999 | Okabe | 439/701 |
| 5,957,732 | 10/1999 | Ito et al. | 439/752 |
| 5,967,857 | 10/1999 | Okabe | 439/701 |

FOREIGN PATENT DOCUMENTS

| | | | |
|---|---|---|---|
| 2-115252 | 9/1990 | Japan | H01R 4/02 |

*Primary Examiner*—Steven L. Stephan
*Assistant Examiner*—Chandrika Prasad
*Attorney, Agent, or Firm*—Sughrue, Mion, Zinn Macpeak & Seas, PLLC

[57] ABSTRACT

A combined-type connector comprises a first connector housing including a base portion having a terminal receiving chamber for receiving a first terminal a leading end portion of which is projected from a front face thereof, a hood portion provided in a front portion of the base portion to define a space for accommodating the leading end portion of the first terminal, a second connector housing including a base portion having a terminal receiving chamber for receiving a second terminal a leading end portion of which is projected from a front face thereof, a hood portion provided in a front portion of the base portion to define a space for accommodating the leading end portion of the second terminal, and a connector receiving chamber provided in the base portion and communicating with the space defined by the hood portion of the first connector housing, wherein when the first connector housing is received by the connector receiving chamber, the hood portion of the first connector housing is arranged in the space defined by the hood portion of the second connector housing and serves as a wall for separating and protecting the leading end portions of the first and second terminal.

8 Claims, 4 Drawing Sheets

COMBINED-TYPE CONNECTOR

BACKGROUND OF THE INVENTION

The present invention relates to a combined-type connector in which a subordinate press-connecting connector, having a plurality of male press-connecting terminals, is combined with a main press-connecting connector having a plurality of male press-connecting terminals.

There is known a press-connecting connector which has enabled a small-size design of a connector, and facilitates the connection of wires constituting a wire harness. Such connectors will be specifically described with reference to FIGS. 4 to 7. The press-connecting connector 1, shown in FIGS. 4 and 5, comprises a housing 2 having a plurality of terminal receiving chambers 2*a*. A press-connecting terminal 3, having a wire W press-connected thereto, is received in each of the terminal receiving chambers 2*a* in the housing 2. A male tab portion 3*a* of each press-connecting terminal 3 projects outwardly from a front side of the housing 2. Openings 2*b*, each communicating with the corresponding terminal receiving chambers 2*a*, are formed respectively in upper and lower sides of the housing 2, and after the wires W are press-connected respectively to press-connecting portions 3*b* of the press-connecting terminals 3, these openings 2*b* are closed respectively by covers (not shown), and the male tab portions 3*a* of the press-connecting terminals 3, projecting from the front side of the housing 2, are covered and protected by a hood 4 of a square tubular shape.

The press-connecting connector 1', shown in FIGS. 6 and 7, comprises a split, hood-like housing including a pair of upper and lower housings 5 and 6, and a male tab portion 3*a* of each press-connecting terminal 3 is protected by a hood portion 5*a*, 6*a* of the housing 5 and 6. Techniques, analogous to these press-connecting connectors 1 and 1', are disclosed in Japanese Utility Model Publication No. Hei 2-115252.

In the above conventional press-connecting connector 1, however, in the process of manufacturing a wire harness, the wires W are connected to the housing 2, with the male tab portions 3*a* exposed to the exterior, and therefore there is a possibility that the male tab portions 3*a* are deformed by the dropping of the housing 2 and the intrusion of the wires W.

In the above conventional press-connecting connector 1', the male tab portions 3*a* of the press-connecting terminals 3 are protected respectively by the hood portions 5*a* and 6*a* of the housings 5 and 6. However, the housings 5 and 6 are separate from each other, and when the housings 5 and 6 are combined, there is a possibility that the hood portions 5*a* and 6*a* of the housings 5 and 6 are prized to be deformed, so that the male tab portions 3*a* of the press-connecting terminals 3 are forcibly deformed.

SUMMARY OF THE INVENTION

The present invention has therefore been made in order to overcome the above problems, and an object of the invention is to provide a combined-type connector in which terminals, received respectively in a plurality of terminal receiving chambers, are positively prevented from being deformed, for example, during the manufacture of a wire harness.

In order to achieve the above object, there is provided a combined-type connector comprising: a first connector housing including: a base portion having a terminal receiving chamber for receiving a first terminal a leading end portion of which is projected from a front face thereof; a hood portion provided in a front portion of the base portion to define a space for accommodating the leading end portion of the first terminal; a second connector housing including: a base portion having a terminal receiving chamber for receiving a second terminal a leading end portion of which is projected from a front face thereof; a hood portion provided in a front portion of the base portion to define a space for accommodating the leading end portion of the second terminal; and a connector receiving chamber provided in the base portion and communicating with the space defined by the hood portion of the first connector housing, wherein when the first connector housing is received by the connector receiving chamber, the hood portion of the first connector housing is arranged in the space defined by the hood portion of the second connector housing and serves as a wall for separating and protecting the leading end portions of the first and second terminal. Further, the hood portion of the first connector housing serves as a rib for reinforcing the hood portion of the second connector housing.

In the connector, the hood portion of the first connector housing may be formed integrally with the base portion thereof. And the hood portion of the second connector housing may be formed integrally with the base portion thereof.

Since the interior of the hood portion of the second connector housing is divided by the hood portion of the first connector housing, therefore the leading end portions of the first and second terminals, projecting into the interior of the respective hood portion, are protected by the hood portion of the first connector housing, and will not be deformed.

Since the hood portion of the second connector housing is reinforced by the hood portion of the first connector housing, the leading end portions of the first and second terminals are positively protected and will not be deformed in accordance with the forcible deformation of the hood portion of the second connector housing, for example, during the manufacture of a wire harness.

Since the hood portions of the first and second connector housings are integrally formed with the base portions thereof, the leading end portions of the first and second terminals will not be deformed in accordance with the intrusion of the electric wire, for example, during the manufacture of a wire harness.

In the connector, the terminal receiving chamber of the first connector housing may have an opened portion to expose the first terminal received therein, and the first connector housing may include a cover for closing the opened portion. A securing mechanism may be provided on the cover of the first connector housing for securing the first terminal received in the terminal receiving chamber when the cover is closed.

Also, the terminal receiving chamber of the second connector housing may have an opened portion to expose the second terminal received therein, and the second connector housing may include a cover for closing the opened portion. A securing mechanism may be provided on the cover of the second connector housing for securing the second terminal received in the terminal receiving chamber when the cover is closed.

Since the first and second terminals, received respectively in the terminal receiving chambers of each of the first connector housing and the second connector housing, are exposed through the associated opened portion, an electric wire can be easily connected to each terminal, and after the wire connection operation is effected, the opened portion in the first connector housing is closed by the cover and thereby the first terminal is secured stably by the securing mechanism on the cover, and then the first connector housing can be easily inserted and received in the connector receiving chamber in the second connector housing, thus combining the two connector housings together.

DETAILED DESCRIPTION OF THE PREFERRED EMBODIMENT

Description of one preferred embodiment of the present invention will now be given below in detail with reference to the accompanying drawings.

Figure 1:
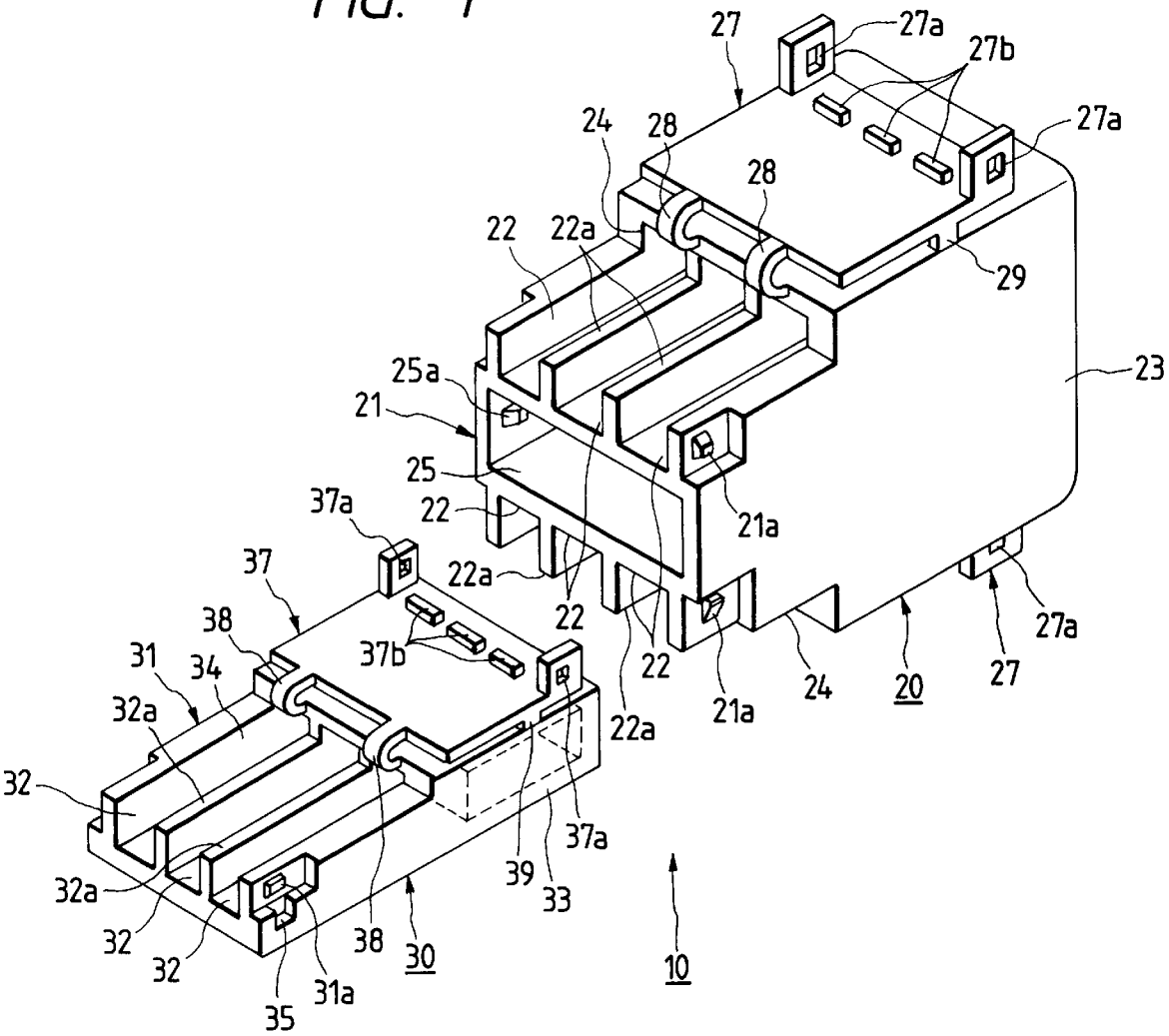
FIG. 1 is a perspective view of one preferred embodiment of a combined-type connector according to the present invention, showing a pre-combined condition.
Figure 2:
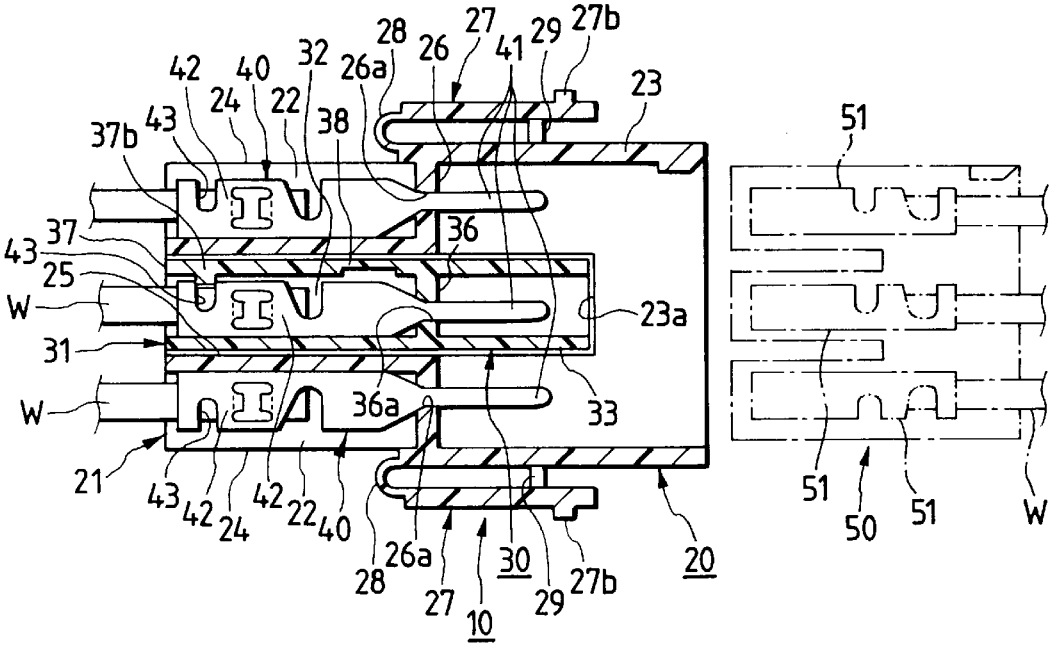
FIG. 2 is a cross-sectional view of the combined-type connector.
Figure 3:
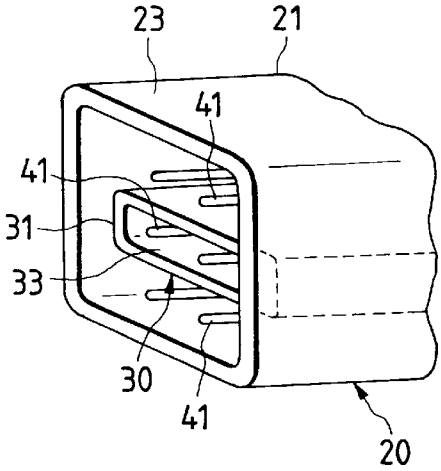
FIG. 3 is a partial perspective view of the combined-type connector including a hood portion.
Figure 4:
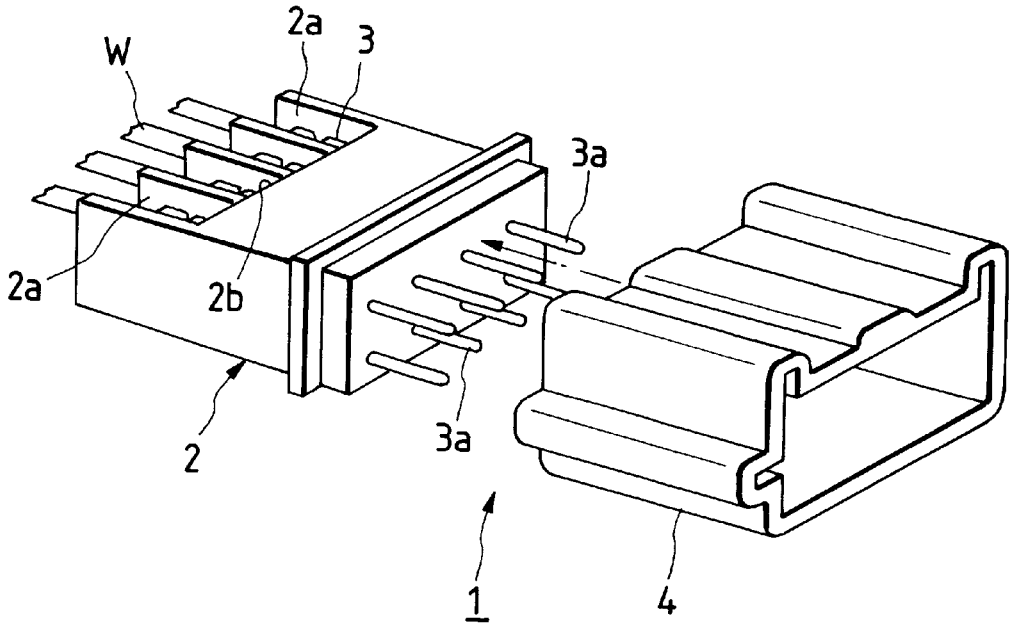
FIG. 4 is an exploded, perspective view of a conventional press-connecting connector.
Figure 5:
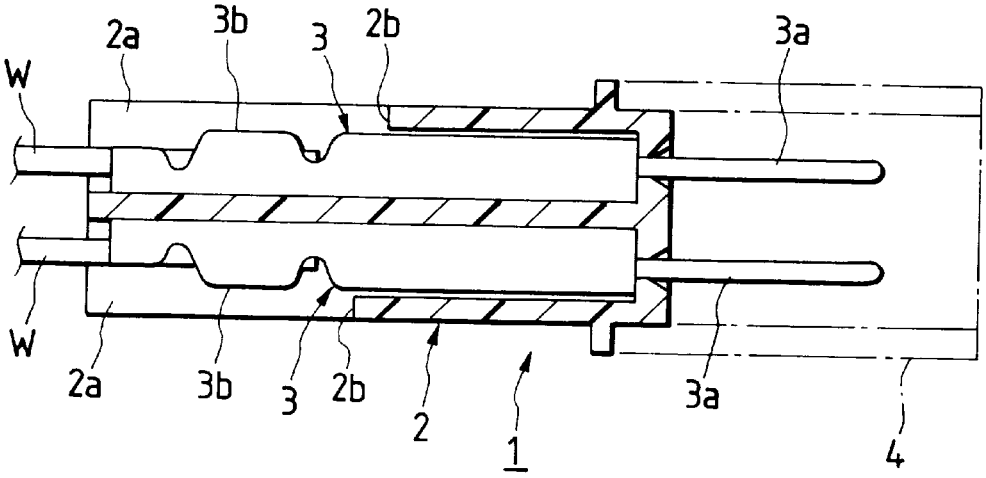
FIG. 5 is a cross-sectional view of the conventional press-connecting connector.
Figure 6:
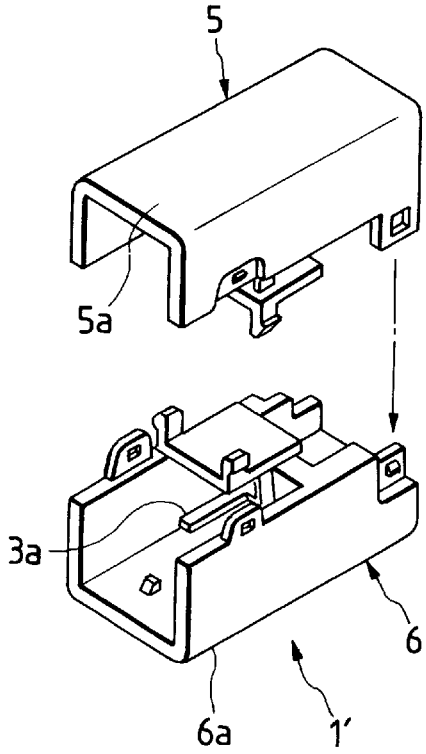
FIG. 6 is an exploded, perspective view of another conventional press-connecting connector.
Figure 7:
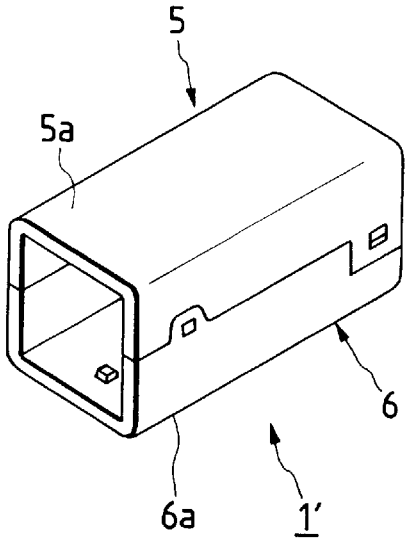
FIG. 7 is a perspective view of the above conventional press-connecting connector.

FIG. 1 is a perspective view of one preferred embodiment of a combined-type connector of the present invention, showing a precombined condition, FIG. 2 is a cross-sectional view of the combined-type connector, and FIG. 3 is a partial perspective view of the combined-type connector including a hood portion.

As shown in FIGS. 1 and 2, the combined-type connector 10 comprises a main connector 20 of a box-shape, which is made of a synthetic resin, and has a plurality of terminal receiving chambers 22 formed on each of upper and lower sides of a base portion of a housing 21, a sub connector 30 of a box-shape, which is made of a synthetic resin, and can be received in a central portion of the main connector 20, and has a plurality of terminal receiving chambers 32 formed on an upper side of a base portion of a housing 31, and male press-connecting terminals 40 received respectively in the terminal receiving chambers 22 and 32 in the connectors 20 and 30, and a wire W is press-connected to each of the press-connecting terminals 40.

As shown in FIG. 1, the terminal receiving chambers 22, formed on each of the upper and lower sides of the housing 21 of the main connector 20, are separated from one another by partition walls 22*a*, and a front portion of the housing 21 is formed into a hood portion 23 of a square tubular shape connected integrally with the partition walls 22*a*. Sub connector receiving recesses 23*a* are formed respectively in central portions of opposed inner side faces of the hood portion 23, and communicate with a sub connector receiving chamber 25 which will be described later. A pair of upper and lower openings 24 are formed respectively in the upper and lower sides of the base portion of the housing 21 of the main connector 20, and each of the openings 24 communicating with the associated terminal receiving chambers 22. The sub connector receiving chamber 25 of a square tubular shape, communicating with the hood portion 23, is integrally formed at the central portion of the base portion of the housing 21 of the main connector 20. A pair of projections (retaining portions) 25*a* are formed integrally at rear portions of opposed inner side faces of the sub connector receiving chamber 25.

As shown in FIG. 2, holes 26*a* for respectively passing male tab portions 41 of the press-connecting terminals 40 therethrough are formed through a separation wall 26 separating the terminal receiving chambers 22 of the housing 21 from the hood portion 23. With this construction, the male tab portions 41 of the press-connecting terminals 40, received respectively in the terminal receiving chambers 22 in the housing 21, project into the hood portion 23. A pair of covers 27 for respectively closing the openings 24 are formed integrally with upper and lower walls of the housing 21 through each pair of hinges 28. Opposite side portions of an outer surface of each cover 27 are connected to the upper (lower) face of the housing 21 by a pair of band-like connecting portions 29 which can be cut. Projecting portions are formed respectively at opposite sides of a rear portion of each cover 27, and engagement holes 27*a* are formed respectively through these projecting portions, and retaining projections 21*a*, formed respectively on opposite side walls of the housing 21, are engageable respectively in these engagement holes 27*a*. A plurality of retaining projections 27*b* are formed integrally on the inner face of each cover 27, and can be retained respectively in recesses 43 of the press-connecting terminals 40, the recess 43 being disposed adjacent to a press-connecting portion 42 of the press-connecting terminal 40.

As shown in FIG. 1, the terminal receiving chambers 32, formed in the housing 31 of the sub connector 30, are separated from one another by partition walls 32*a*, and a front portion of this housing 31 is formed into a hood portion 33 of a square tubular shape integrally connected to the partition walls 32*a*. When the housing 31 of the sub connector is fitted and received in the sub connector receiving chamber 25 in the housing 21 of the main connector 20, the hood portion 33 projects into the interior of the hood portion 23 of the housing 21 of the main connector 20, and serves as a terminal protection rib for preventing the forcible deformation of the male tab portions 41 of the press-connecting terminals 40 in the main connector 20. An opening 34, communicating with the terminal receiving chambers 32, is formed in the upper side of the base portion of the housing 31 of the sub connector 30. Recesses 35 are formed respectively in the opposite side faces of the housing 31 of the sub connector 30 at the rear portion thereof, and the projections 25*a* of the sub connector receiving chamber 25 are engageable respectively in these recesses 35.

As shown in FIG. 2, holes 36*a* for respectively passing the male tab portions 41 of the press-connecting terminals 40 therethrough are formed through a separation wall 36 separating the terminal receiving chambers 32 of the housing 31 from the hood portion 33. With this construction, the male tab portions 41 of the press-connecting terminals 40, received respectively in the terminal receiving chambers 32 in the housing 31, project into the hood portion 33. A cover 37 for closing the opening 34 is formed integrally with an upper wall of the housing 31 through a pair of hinges 38. Opposite side portions of an outer face of the cover 37 are connected to the upper face of the housing 31 by a pair of band-like connecting portions 39 which can be cut. Projecting portions are formed respectively at opposite sides of a rear portion of the cover 37, and engagement holes 37*a* are formed respectively through these projecting portions, and retaining projections 31*a*, formed respectively on the opposite side walls of the housing 31, are engageable respectively in these engagement holes 37*a*. A plurality of retaining projections 37*b* are formed integrally on the inner face of the cover 37, and can be retained respectively in recesses 43 of the press-connecting terminals 40, the recess 43 being disposed adjacent to the press-connecting portion 42 of the press-connecting terminal 40.

Further, as shown in FIG. 2, the press-connecting terminals 40 are received respectively in the terminal receiving chambers 22 of the main connector 20 and the terminal receiving chambers 32 of the sub connector 30, and the wires W are press-connected respectively to the press-connecting portions 42 of these press-connecting terminals 40, and then the housing 31 of the sub connector 30 is inserted into the sub connector receiving chamber 25 in the housing 21 of the main connector 20, thus combining the two connectors together. In this condition, the male tab portions 41 of the press-connecting terminals 40 project into the hood portions 23 and 33 of the main and sub connectors 20 and 30, and the two connectors, combined together, serves as a female connector. Then, a mating male connector 50 is fitted into the hood portions 23 and 33 of this female, combined-type connector 10, so that the male tab portions 41 of the press-connecting terminals 40 in the combined-type connector 10 are electrically connected respectively to female press-connecting terminals 51 in the male connector 50.

In the combined-type connector 10 of this embodiment, as shown in FIG. 1, the press-connecting portions 42 of the press-connecting terminals 40, received respectively in the terminal receiving chambers 22 in the main connector 20 are exposed through the openings 24 formed in the base portion of the main connector 20, and also the press-connecting portions 42 of the press-connecting terminals 40, received respectively in the terminal receiving chambers 32 in the sub connector 30 are exposed through the opening 34 formed in the base portion of the sub connector 30, and therefore the wire W can be easily press-connected to the press-connecting portion of each press-connecting terminal 40. At this time, the male tab portions 41 of the press-connecting terminals 40 are protected by the hood portions 23 and 33 of the connectors 20 and 30, and therefore the male tab portions 41 of the press-connecting terminals 40 will not be deformed by the dropping of the housings 21 and 31 and the intrusion of the wires W. After the press-connection of the wires W is effected, the pair of connecting portions 39 are cut, and when the opening 34 in the sub connector 30 is closed by the cover 37, the engagement holes 37*a* in the cover 37 are retainingly engaged respectively with the retaining projections 31*a* on the housing 31, and also the retaining projections 37*b* on the cover 37 are engaged respectively in the recesses 43 formed respectively in the press-connecting terminals 40. The sub connector 30 in this condition can be easily inserted and received in the sub connector receiving chamber 25 in the main connector 20, thus combining the two connectors together.

After the sub connector 30 is received in the sub connector receiving chamber 25 in the main connector 20, each pair of connecting portions 29 are cut, and when the openings 24 in the main connector 20 are closed respectively by the covers 27, the engagement holes 27*a* in each cover 27 are retainingly engaged respectively with the retaining projections 21*a* on the housing 21, and also the retaining projections 27*b* on the cover 27 are engaged respectively in the recesses 43 formed respectively in the press-connecting terminals 40. At this time, the interior of the hood portion 23 of the main connector 20 is divided by the hood portion 33 of the sub connector 30, and the hood portion 23 is reinforced by the hood portion 33, and therefore the male tab portions 41 of the press-connecting terminals 40, projecting into the interior of the hood portion 23 of the main connector 20, are positively protected by the hood portion 23 of the main connector 20 and the hood portion 33 of the sub connector 30, thereby positively preventing the deformation of the male tab portions 41 of the press-connecting terminals 40. Namely, the male tab portions 41 of the press-connecting terminals 40, projecting into the hood portion 23 of the main connector 20, can be protected by the hood portion 33 of the sub connector 30 serving as the terminal protection rib, and therefore the deformation of the hood portion 23 of the main connector 20 is positively prevented during the manufacture of a wire harness, thereby positively preventing the forcible deformation of the male tab portions 41 of the press-connecting terminals 40 disposed within the hood portion 23 of the main connector 20.

In the above embodiment, although one sub connector receiving chamber is provided in the main connector, a plurality of sub connector receiving chambers may be provided so that a plurality of sub connectors can be combined with the main connector. The press-connecting terminals are not limited to the male type, but may be of the female type. The terminals are not limited to the press-connecting type in which the wire is press-connected to the terminal by press-connecting blades, but may be any other suitable type such as a crimp-type terminal to which the wire is connected by clamping. As has been described heretofore, according to the present invention, since the interior of the hood portion of the main connector is divided by the hood portion of the sub connector, therefore the tab portions of the terminals, projecting into the interior of the respective hood portion, are protected by the hood portion of the sub connector housing, and will not be deformed.

According to the present invention, since the hood portion of the main connector is reinforced by the hood portion of the sub connector, the tab portions of the terminals are positively protected and will not be deformed in accordance with the forcible deformation of the hood portion of the main connector, for example, during the manufacture of the wire harness.

According to the present invention, since the hood portions of the sub and main connector are integrally formed with the base portions thereof, the tab portions of the terminals will not be deformed in accordance with the intrusion of the electric wire, for example, during the manufacture of the wire harness.

According to the present invention, since the terminals, received respectively in the terminal receiving chambers of each of the sub connector and the main connector, are exposed through the associated opening, an electric wire can be easily connected to each terminal, and after the wire connection operation is effected, the opening in the sub connector is closed by the cover and thereby the terminal is secured stably by the securing mechanism on the cover, and then the sub connector can be easily inserted and received in the connector receiving chamber in the main connector, thus combining the two connectors together.

The present invention is not limited to the above embodiment but various changes and modifications are possible without departing from the spirit and the scope of the invention.

What is claimed is:

1. A combined-type connector comprising:

a first connector housing including:

a base portion having a terminal receiving chamber for receiving a first terminal a leading end portion of which is projected from a front face thereof;

a hood portion provided in a front portion of the base portion to define a space for accommodating the leading end portion of the first terminal;

a second connector housing including:

a base portion having a terminal receiving chamber for receiving a second terminal a leading end portion of which is projected from a front face thereof;

a hood portion provided in a front portion of the base portion to define a space for accommodating the leading end portion of the second terminal; and a connector receiving chamber, for receiving the first connector housing, provided in the base portion and communicating with the space defined by the hood portion thereof, wherein when the first connector housing is received by the connector receiving chamber of the second connector housing, the hood portion of the first connector housing is arranged in the space defined by the hood portion of the second connector housing and serves as a wall for separating and protecting the leading end portions of the first and second terminal.

2. The combined-type connector as set forth in claim 1, wherein when the first connector housing is received by the connector receiving chamber, the hood portion of the first connector housing serves as a rib for reinforcing the hood portion of the second connector housing.

3. The combined-type connector as set forth in claim 1, wherein the hood portion of the first connector housing is formed integrally with the base portion thereof.

4. The combined-type connector as set forth in claim 1, wherein the hood portion of the second connector housing is formed integrally with the base portion thereof.

5. The combined-type connector as set forth in claim 1, wherein the terminal receiving chamber of the first connector housing has an opened portion to expose the first terminal received therein, and the first connector housing includes a cover for closing the opened portion.

6. The combined-type connector as set forth in claim 5, wherein a securing mechanism is provided on the cover of the first connector housing for securing the first terminal received in the terminal receiving chamber when the cover is closed.

7. The combined-type connector as set forth in claim 1, wherein the terminal receiving chamber of the second connector housing has an opened portion to expose the second terminal received therein, and the second connector housing includes a cover for closing the opened portion.

8. The combined-type connector as set forth in claim 7, wherein a securing mechanism is provided on the cover of the second connector housing for securing the second terminal received in the terminal receiving chamber when the cover is closed.

* * * * *